United States Patent [19]

Higashiguchi

[11] 4,243,470

[45] Jan. 6, 1981

[54] DEVICE FOR THERMALLY APPLYING STICKERS OR MARKS TO ARTICLES

[76] Inventor: Shigehiko Higashiguchi, 4-2 Honjyo 3-chome, Sumida-ku, Tokyo, Japan

[21] Appl. No.: 927,123

[22] Filed: Jul. 24, 1978

[30] Foreign Application Priority Data

Nov. 11, 1977 [JP] Japan ..... 52-136168[U]

[51] Int. Cl.[3] ..... B30B 5/02; D06F 71/40

[52] U.S. Cl. ..... 156/583.9; 38/12

[58] Field of Search ..... 156/583, 583.8, 583.9; 38/12, 17

[56] References Cited

U.S. PATENT DOCUMENTS

| | | | |
|---|---|---|---|
| 1,657,564 | 1/1928 | Clisson | 38/12 |
| 2,073,220 | 3/1937 | Percy | 38/12 |
| 2,286,348 | 6/1942 | Custer | 38/12 |
| 2,369,362 | 2/1945 | Marziani | 156/583 |
| 2,651,350 | 8/1953 | Casey | 156/583 |
| 3,923,590 | 12/1975 | Humphries | 156/583 |

*Primary Examiner*—Douglas J. Drummond

*Attorney, Agent, or Firm*—Pearne, Gordon, Sessions, McCoy & Granger

[57] ABSTRACT

A device for thermally applying a sticker or mark to a clothing article which essentially comprises a base to be horizontally supported on a support surface, a standard extending upwardly of the base, a manual operation handle pivoted to said standard, a stationary or pivotable heat plate on said standard, a pivotal or stationary holding plate for applying the sticker to the clothing article in cooperation with the heat plate and having holding means to hold the article and sticker in position during the sticker application operation.

9 Claims, 3 Drawing Figures

DEVICE FOR THERMALLY APPLYING STICKERS OR MARKS TO ARTICLES

BACKGROUND OF THE INVENTION

This invention relates to a device for thermally applying stickers or marks to articles to be decorated with the stickers or marks and more particularly, to a device for thermally applying stickers or marks to articles to be decorated with the stickers or marks to the surface of clothing articles such as shirts or uniforms by means of thermalpressure sensitive resin adhesive.

There have been proposed and practically employed a variety of methods for applying stickers or marks to secondary products such as clothing articles. In one of the prior art sticker or mark application methods, the sticker is manually sewn to the clothing article. In another prior art sticker application method, one or the base surface of the sticker applied thereto a thermal-pressure sensitive syhthetic resin adhesive, the adhesive is allowed to dry and the sticker is pressed against the surface of the clothing article by applying heat and pressure to the sticker by means of an iron to cause the adhesive to melt and adhere to the article.

However, the former method has the disadvantages that the thread employed in sewing the sticker to the clothing article comes out of the surface of the article to make the external appearance of the clothing article unpleasant and that the productivity of the method is quite low. The latter method has the disadvantages that the article and sticker are in many cases displaced relative to each other when pressure is applied thereto, so that when the sticker application is performed by an unskilled operator, the clothing article would have creases therein and that since the heat and pressure application means is caused to directly contact the clothing article, the area of the article where the heat and pressure application means contacts is excessively rubbed to be polished resulting in the lowering of the quality of the processed clothing article.

SUMMARY OF THE INVENTION

Therefore, one object of the present invention is to eliminate the disadvantages inherent in the prior arts referred to hereinabove.

Another object of the present invention is to prevent the clothing article and sticker from displacing relative to each other by holding the article and sticker by means of the points of needles during the application of pressure to the clothing article and sticker.

A further object of the present invention is to eliminate the possibility of rubbing of the clothing article which may result in polishing of the article by the point contact between the points of needles and the clothing article during the pressure application operation.

The above and other objects and attendant advantages of the present invention will be more readily apparent to those skilled in the art from a reading of the following detailed description in conjunction with the accompanying drawings which show preferred embodiments of the present invention for illustration purposes only, but not for limiting the scope of the same in any way.

PREFERRED EMBODIMENTS OF THE INVENTION

Figure 1:
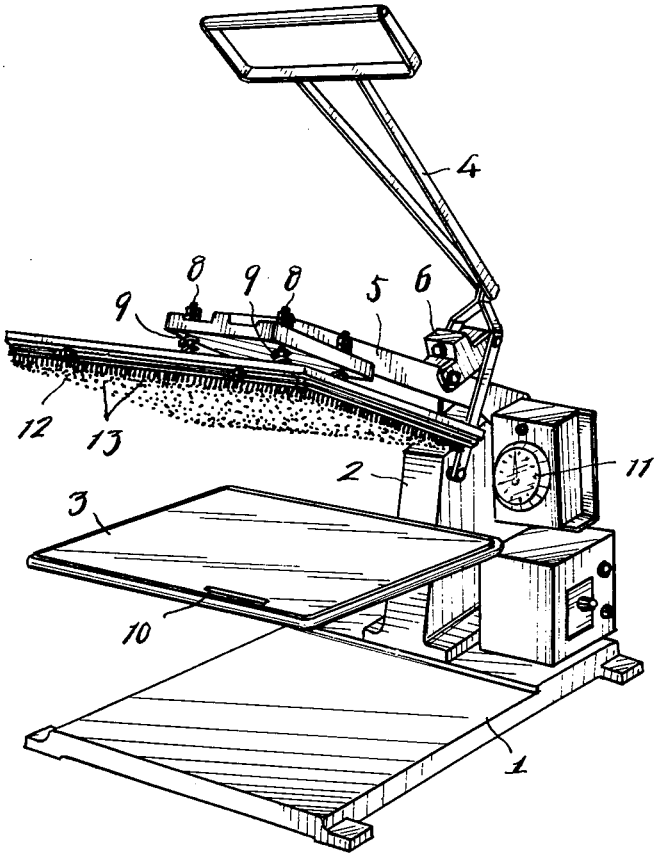
FIG. 1 is a perspective view of a first embodiment of the device for thermally applying stickers or marks to clothing articles constructed in accordance with the present invention.

The present invention will be now described referring to the accompanying drawings and more particularly, to FIG. 1 thereof in which the first embodiment of the device for thermally applying thermo-pressure sensitive stickers or marks to clothing articles of the invention is shown.

The device generally comprises a base 1 to be horizontally suppported on a suitable stationary support surface such as a floor and a standard 2 extending at right angles to the upper surface of the base and fixedly secured at the lower end to the base surface on the rear portion of the base. The standard 2 has the front face which slightly inclines with respect to the vertical. A stationary heat plate 3 is fixedly secured at the rear side edge thereof to and extends horizontally and forwardly of the front face of the standard 2 midway of the height of the latter. The heat plate 3 has a heater (not shown) therein which is electrically connected to a power source (not shown). A manually operated handle 4 is suitably pivoted at the bifurcated lower end thereof to the opposite sides of the standard 2 and extends upwardly to be manually operated at the upper end thereof by the operator. A support arm 5 is pivoted midway between the front and rear ends of the arm to a connection member 6 which embraces the arm and is in turn secured at the rear end to the handle 4 above the heat plate 3. A holding plate 7 is supported on the support arm 5 through bolts 8 and springs 9 in opposition to the heat plate so that the holding plate 7 can move towards and away from the working surface of the heat plate 3 as the support arm 5 pivots in one or the other direction as a result of the pivotal movement of the handle 4 and even when the holding plate 7 strikes against the heat plate 3 with a high impacting force, such impacting force can be substantially absorbed by the springs 9 to thereby eliminate possible damage of the holding plate and/or heat plate. The holding plate 7 is a first platen and the heat plate 3 is a second platen cooperable therewith and together defining sticker application means to adhere a sticker to an article such as clothing by heat and pressure.

Reference numeral 10 denotes a thermometer which is embedded in the upper surface of the heat plate 3 to indicate the temperature of the heat plate during the operation of the device and reference numeral 11 denotes a manual temperature adjuster which when manually operated is adpted to adjust the temperature of the heat plate to a desired or predetermined value.

Figure 2:
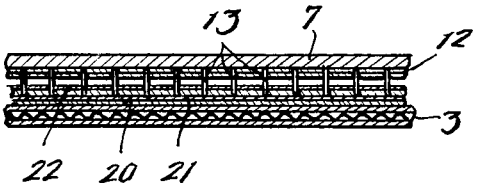
FIG. 2 is a fragmentary cross-sectional view showing the manner in which the cooperating heat plate and sticker holding plate operate in thermally applying a thermo-pressure sensitive sticker or mark to a clothing article.

The holding plate 7 has a holding means applied to the working surface thereof facing the heat plate 3. As more clearly shown in the enlarged cross-sectional view of FIG. 2, the holding means comprises two laminated heat-resistant cloth layers 12 and a plurality of small needles 13 distributed throughout the area of the cloth layers in a closely spaced relationship with each other. The needles 13 extend through the two cloth layers with the lower ends or tips thereof protruding out of the outer surface of the outer cloth layer for the purpose to be described hereinafter.

Figure 3:
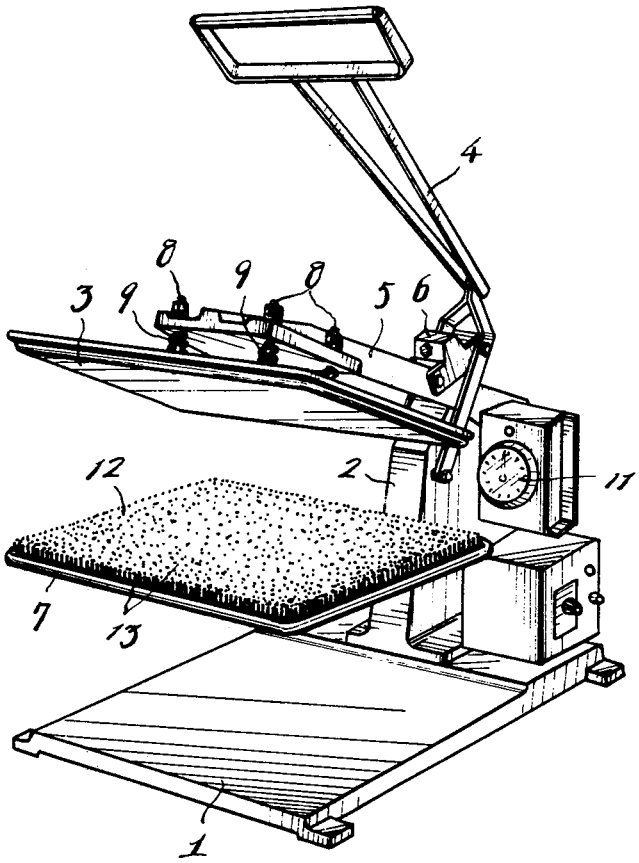
FIG. 3 is a perspective view of a second embodiment of the device for thermally applying stickers or marks to clothing articles constructed in accordance with the present invention.

FIG. 3 shows the second embodiment of the device constructed in accordance with the present invention. The second embodiment is substantially similar to the first embodiment except for the arrangement of the heat plate and holding plate 7 and thus, the same numerals are assigned to the corresponding parts of the second embodiment of FIG. 3. In the second embodiment, the holding plate 7 is fixedly secured at the rear side edge thereof to and extends horizontally and forwardly of the front face of the standard 2 midway of the height of the latter. The heat plate 3 is movably supported by the support arm 5 similar to that associated with the movable holding plate 7 of the first embodiment for movement towards and away from the stationary holding plate 7. The operation of the second embodiment of the device is substantially similar to that of the first embodiment except that the heat plate is moved towards and away from the stationary holding plate as the manually operated handle 4 is operated.

In the operation of the first embodiment of the device, first of all, a clothing article (not shown) to be decorated with a sticker or mark is placed on the heat plate 3 and a thermo-pressure sensitive sticker or mark having a selected pattern or design is then placed on the article. The thermo-pressure sensitive sticker or mark comprises a thermo-pressure sensitive synthetic resin adhesive film 20 and short fibers 22 flocked to one surface of the film by means of an adhesive layer 21. After the article and sticker have been placed on the heat plate 3 in the order mentioned above, the handle 4 is pivoted downwardly to move the holding plate 7 downwardly towards the heat plate 3 through the pivot arrangement 5, 6, 7 until the holding plate 7 abuts against the heat plate 3 whereby the points of the needles 13 of the holding means penetrate into the sticker and article to positively hold them on the heat plate. Thereafter, the power source is operated to energize the heater in the heat plate 3 so as to heat the plate 3. As the heat plate 3 is heated to a predetermined temperature, the resin adhesive film 20 melts and adheres to the article to thereby decorate the article with the sticker.

As clear from the foregoing description on the first embodiment of the invention, when the holding plate 7 has moved downwardly to abut against the heat plate 3 on which the article and sticker are placed a stack and the heat plate has been heated to a predetermined temperature, the resin adhesive film 20 of the sticker or mark melts and adheres to the article by the heat provided by the heat plate 3 and the pressure provided by the holding plate 7. During the sticker application operation, the article and sticker are positively held in position by the needles 13 whereby there is no possibility of displacement of the article and/or sticker which may crease the article. And since the needle points make point contact with the sticker and article, the needles would not rub the article to thereby eliminate any polishing of the article and ensure orderly application of the sticker to the article. Furthermore, since the cloth layers 12 of the holding means are porous to provide air permeability, vapor can easily pass through the holding means and the holding means can dry quickly.

While only two embodiments of the invention have been shown and described in detail, it will be understood that the same are for illustration purpose only, but not for limiting the scope of the same in any way.

What is claimed is:

1. In a device for thermally applying a sticker or mark to an article, sticker application means having first and second platens with working faces relatively movable apart and together to apply heat and pressure to the sticker and article, at least one of the platens being heated, and the first platen having holding means on the working surface thereof to aid holding the article in place, characterized in that said holding means includes a plurality of needles extending toward said second platen on a majority of the area of the working surface of said first platen to engage the article.

2. The device as set forth in claim 1, wherein said plurality of needles are substantially normal to the working surface of said first platen.

3. The device as set forth in claim 1, wherein said plurality of needles are provided at least in the central area of said first platen.

4. The device as set forth in claim 1, wherein said plurality of needles are provided on substantially the entire working surface of said first platen.

5. The device as set forth in claim 1, wherein said holding means includes a layer of heat resistant cloth on the working surface of said first platen and through which said needles extend.

6. The device as set forth in claim 1, wherein said holding means includes plural layers of heat resistant cloth with the tips of said needles protruding through the outermost layer.

7. The device as set forth in claim 1, wherein the second platen is a stationary heated plate having the working surface thereof facing upwardly and the first platen is pivotally connected thereto to have the holding means thereof movable downwardly toward engagement with the second platen.

8. The device as set forth in claim 1, wherein the first platen is stationary having the working surface thereof facing upwardly and the second platen is heated and is pivotally connected thereto to have the heated working surface thereof movable downwardly toward engagement with the first platen.

9. The device as set forth in claim 1, wherein said needles are short and are spaced closely together.

* * * * *

UNITED STATES PATENT AND TRADEMARK OFFICE

CERTIFICATE OF CORRECTION

PATENT NO. : 4,243,470

DATED : January 6, 1981

INVENTOR(S) : Shigehiko Higashiguchi

It is certified that error appears in the above—identified patent and that said Letters Patent is hereby corrected as shown below:

Column 1, line 20, after "sticker" insert --has--.

Column 3, line 50, after "placed" insert --in--.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*